US008833480B2

(12) United States Patent
Grimes et al.

(10) Patent No.: US 8,833,480 B2
(45) Date of Patent: Sep. 16, 2014

(54) COUPLER WITH VISIBILITY WINDOW

(75) Inventors: Joel Robert Grimes, Fuquay-Varina, NC (US); Bradley Robert Lancaster, Raleigh, NC (US); Andrew Lee Vering, Manhattan, KS (US); Wayne Edward Harshberger, II, Oswego, IL (US); Anand Ramchandra Mijar, Raleigh, NC (US)

(73) Assignee: Caterpillar Inc., Peoria, IL (US)

( * ) Notice: Subject to any disclaimer, the term of this patent is extended or adjusted under 35 U.S.C. 154(b) by 500 days.

(21) Appl. No.: 13/168,801

(22) Filed: Jun. 24, 2011

(65) Prior Publication Data

US 2012/0325505 A1 Dec. 27, 2012

(51) Int. Cl.
*A01B 51/00* (2006.01)
*E02F 3/36* (2006.01)

(52) U.S. Cl.
CPC ..... *E02F 3/3627* (2013.01); *E02F 3/364* (2013.01); *E02F 3/3663* (2013.01); *E02F 3/3631* (2013.01)
USPC ..... 172/272

(58) Field of Classification Search
USPC ..... 37/403, 405, 468; 172/272, 273, 439, 172/753; 414/723, 687, 695.5–695.8, 694, 414/686
See application file for complete search history.

(56) References Cited

U.S. PATENT DOCUMENTS 3,760,883 A 9/1973 Birk
3,818,551 A 6/1974 Coughran, Jr.
4,243,356 A 1/1981 Takojima
4,251,181 A 2/1981 Drott et al.
4,345,870 A 8/1982 Anderson et al.
4,674,945 A 6/1987 Huldén
4,955,779 A 9/1990 Knackstedt
5,024,010 A 6/1991 Hulden
5,107,610 A 4/1992 Fusco
5,333,695 A 8/1994 Walter
5,597,283 A 1/1997 Jones
5,692,850 A 12/1997 Kimble et al.
5,974,706 A 11/1999 Kaczmarski et al.

(Continued)

FOREIGN PATENT DOCUMENTS

DE 92 18 306 U1 11/1993
DE 93 14 409 U1 3/1994

(Continued)

*Primary Examiner* — Robert Pezzuto
(74) *Attorney, Agent, or Firm* — Finnegan, Henderson, Farabow, Garrett & Dunner LLP

(57) ABSTRACT

A coupler for connecting an implement to a machine includes a first mounting structure configured to attach the coupler to the implement. The first mounting structure includes a first actuator including a first cylinder rod extendable relative to a first cylinder body. The first cylinder rod has a first rod longitudinal axis. The first mounting structure also includes a first wedge attached to the first cylinder rod. The first wedge is movable between a retracted position and an extended position by the first actuator. The first wedge includes a first wedge tip insertable into the implement. The first wedge tip has a first wedge longitudinal axis. The first rod longitudinal axis is offset from the first wedge longitudinal axis to form a first opening extending through the coupler adjacent the first actuator. The coupler also includes a second mounting structure configured to attach the coupler to the machine.

22 Claims, 6 Drawing Sheets

(56) References Cited

U.S. PATENT DOCUMENTS

| | | | | |
|---|---|---|---|---|
| 6,227,792 | B1 | 5/2001 | Baker et al. | |
| 7,478,490 | B2 * | 1/2009 | Segerljung | 37/468 |
| 7,814,689 | B2 | 10/2010 | Vering et al. | |
| 7,882,898 | B1 | 2/2011 | Vering et al. | |
| 2006/0242865 | A1 | 11/2006 | Herguido Fo | |
| 2009/0074551 | A1 | 3/2009 | Opperud | |

FOREIGN PATENT DOCUMENTS

| | | | |
|---|---|---|---|
| EP | 0 278 571 | A1 | 8/1988 |
| GB | 2466017 | A | 6/2010 |
| WO | WO 91/18716 | A1 | 12/1991 |
| WO | WO 00/75437 | A1 | 12/2000 |
| WO | WO 2005/093171 | A1 | 10/2005 |
| WO | WO 2005/093172 | A1 | 10/2005 |

* cited by examiner

COUPLER WITH VISIBILITY WINDOW

TECHNICAL FIELD

The present disclosure relates generally to a coupler, and more particularly, to a coupler including at least one visibility window.

BACKGROUND

Typically implements are coupled to mining and construction machines, such as wheel loaders, hydraulic excavators, skid steer loaders, multi-terrain loaders, track loaders, backhoe loaders, etc., to perform work. One example of such an implement is a pallet fork. A pallet fork may be mounted to one of these machines for performing work, such as picking up and carrying palletized materials around a building site or at a factory. Other non-limiting examples of implements include buckets, hammers, blades, brooms, and snow plows.

When a particular implement is attached to the machine, it enables the machine to perform a variety of tasks. Different implements may be attached to enable the machine to perform different tasks. The ability to attach multiple implements to a machine so the machine can perform a variety of tasks, which is called "multitasking," increases the utility and value of the machine for the owner. On the other hand, attaching and detaching implements to a machine may be cumbersome and time consuming. The time spent switching implements instead of working reduces the utility of the machine.

Some implements may be mounted to a machine with a simple pin-style joint, which does not facilitate the switching of implements. To create the pin-style joint, a pin is manually inserted into complementary bores in the machine and implement. Switching implements with this pin-style joint requires an operator or technician, or multiple technicians, to manually remove the pins that hold the first implement to the machine, remove the first implement, position a second implement on the machine, and manually reinsert the pins. Besides being time consuming, this switching operation may require considerable skill on the part of the operator and technicians.

A coupler solves many of the problems that pin-style joints present for switching implements. The coupler provides an alternative way to mount implements to mining and construction machines. The coupler is interposed at the junction between the machine and the implement. The implement is attached to the coupler, and the coupler is attached to the machine. When switching implements, the operator of the machine may operate the coupler from inside the machine's cab to release a first implement. The machine is then repositioned near a second implement, where the operator may then manipulate the coupler and the machine to pick up the second implement.

One example of a coupler is described in U.S. Pat. No. 7,814,689 (the '689 patent) issued to Vering et al. The '689 patent describes a coupler for connecting a pallet fork to a machine. The coupler includes a mounting structure for mounting the coupler to the machine and a mounting structure for mounting the coupler to an instrument, such as a bucket or pallet fork. The mounting structure for mounting the coupler to the implement includes wedges that are received in wedge pockets in the implement.

Although the coupler of the '689 patent may be able to connect an implement to the machine, the coupler may not provide sufficient visibility to allow the operator of the machine to see, for example, the tines of the pallet fork from the cab of the machine. As a result, the coupler may prevent the operator from being able to see tines of the pallet fork when attempting to position the pallet fork, e.g., to pick up palletized materials.

The disclosed system is directed to overcoming one or more of the problems set forth above.

SUMMARY

In one aspect, the present disclosure is directed to a coupler for connecting an implement to a machine. The coupler includes a first mounting structure configured to attach the coupler to the implement. The first mounting structure includes a first actuator including a first cylinder rod extendable relative to a first cylinder body, and the first cylinder rod has a first rod longitudinal axis. The first mounting structure also includes a first wedge attached to the first cylinder rod, and the first wedge is movable between a retracted position and an extended position by the first actuator. The first wedge includes a first wedge tip insertable into the implement, and the first wedge tip has a first wedge longitudinal axis. The first rod longitudinal axis is offset from the first wedge longitudinal axis to form a first opening extending through the coupler adjacent the first actuator. The coupler also includes a second mounting structure configured to attach the coupler to the machine.

In another aspect, the present disclosure is directed to a coupler for coupling a first body to a second body. The coupler includes a frame including a first mounting structure configured to attach the coupler to the first body and a second mounting structure configured to attach the coupler to the second body. The first mounting structure includes a first actuator including a first cylinder rod extendable relative to a first cylinder body, and the first cylinder rod has a first rod longitudinal axis. The first mounting structure also includes a first wedge attached to the first cylinder rod, and the first wedge is movable between a retracted position and an extended position by the first actuator. The first wedge includes a first wedge tip insertable into the first body, and the first wedge tip has a first wedge longitudinal axis. The first rod longitudinal axis is offset from the first wedge longitudinal axis to form a first opening extending through the coupler adjacent the first actuator. The first opening extends between the frame and the first actuator above the first wedge, and the first wedge longitudinal axis extends towards the first opening.

In a further aspect, the present disclosure is directed to a method of coupling an implement to a machine. The method includes attaching a coupler to the machine and attaching the implement to the coupler by actuating a first actuator including a first cylinder rod extendable relative to a first cylinder body. The first cylinder rod has a first rod longitudinal axis, and a first wedge is attached to the first cylinder rod. The first wedge is movable between a retracted position and an extended position when the first actuator is actuated. The implement is also attached to the coupler by advancing a first wedge tip of the first wedge into a first wedge pocket in the implement when the first actuator is actuated to position the first wedge in the extended position. The first wedge tip has a first wedge longitudinal axis, and the first rod longitudinal axis is offset from the first wedge longitudinal axis. The method also includes providing a first opening extending through the coupler and adjacent the first actuator to allow an operator operating the machine in a cab of the machine to see through the first opening to at least a portion of the implement.

DETAILED DESCRIPTION

Reference will now be made in detail to exemplary embodiments of the invention, examples of which are illustrated in the accompanying drawings. Wherever possible, the same reference numbers will be used throughout the drawings to refer to the same or like parts.

Figure 1:
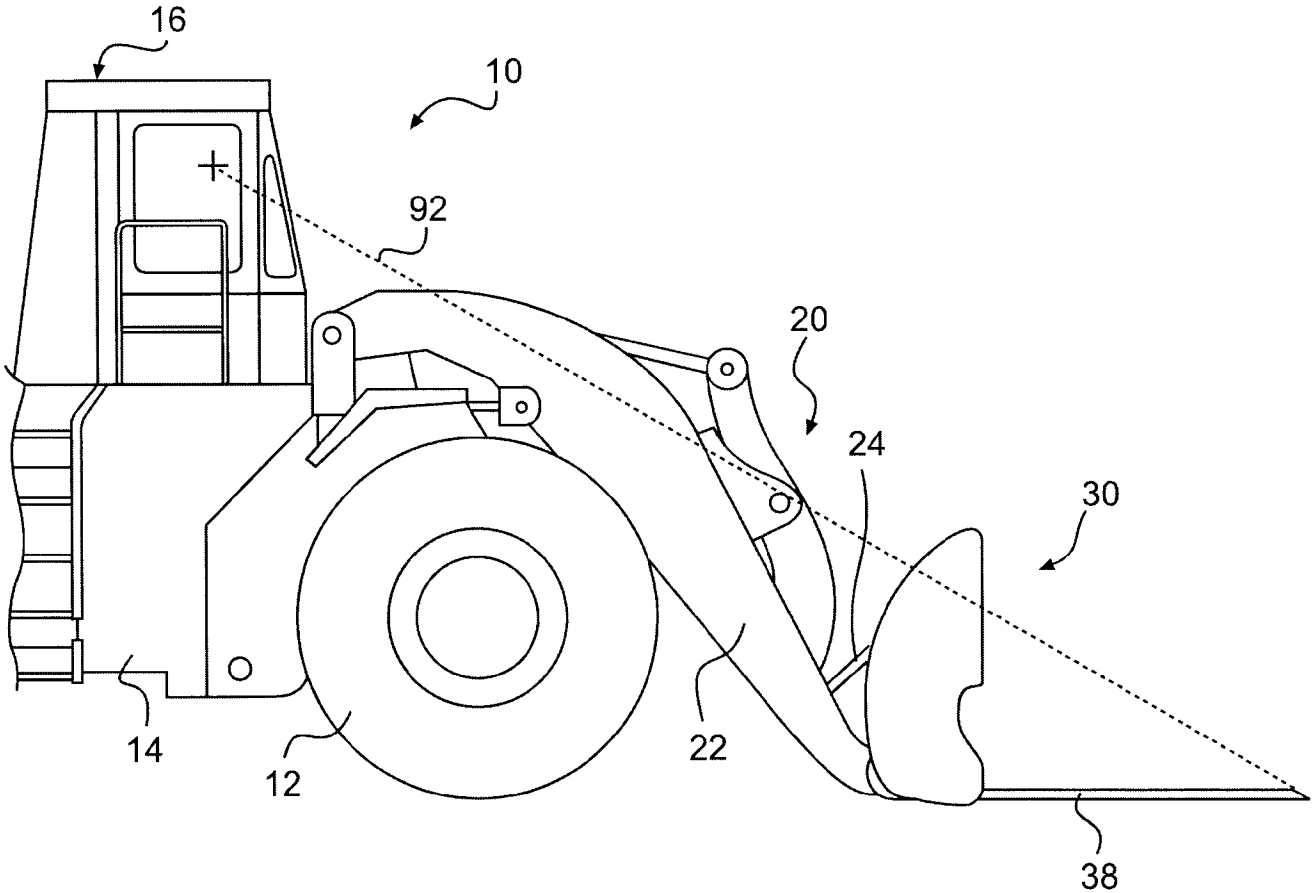
FIG. 1 is a side view of a machine with a pallet fork, according to an exemplary embodiment.

FIG. 1 illustrates an exemplary machine 10 having multiple systems and components that cooperate to accomplish a task. The machine 10 may be a fixed or mobile machine that performs some type of operation associated with an industry such as mining, construction, farming, transportation, or any other industry known in the art. For example, the machine 10 may be an earth moving machine such as an excavator, a dozer, a loader (e.g., a wheel loader or track type loader), a backhoe, a motor grader, a dump truck, or any other earth moving machine. The machine 10 may include an implement, such as a bucket, fork, or other tool used to perform a task.

In an exemplary embodiment, the machine 10 may be a wheel loader, and the implement may be a pallet fork 30, as shown in FIG. 1. The machine 10 may include wheels 12 or other ground engaging device for maneuvering, moving, or otherwise positioning the machine 10. The machine 10 may also include a frame 14 that may have an operator's control station or cab 16 mounted thereon. The frame 14 may also include a linkage system 20 extending from the frame 14. The linkage system 20 may include one or more lift arms 22 and one or more tilt links 24. In the exemplary embodiment, the linkage system 20 includes two lift arms 22 and one tilt link 24. The pallet fork 30 may be pivotally attached to the lift arms 22 and the tilt link 24, which are adapted to control the pallet fork 30 to perform various operations, such as pick up and drop off of palletized or non-palletized materials (not shown).

Figure 2:
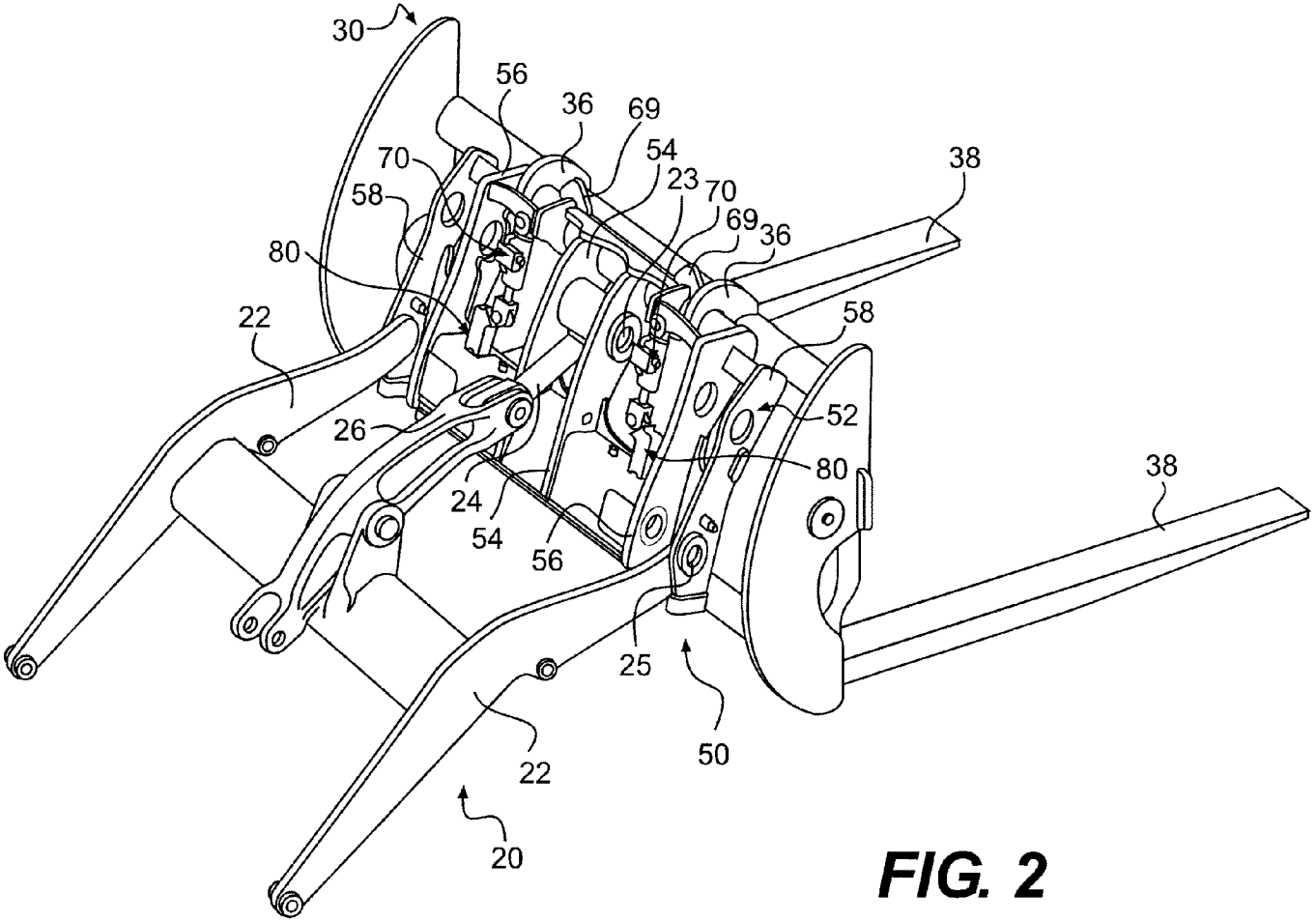
FIG. 2 is a perspective view of a coupler connecting the pallet fork to a linkage system of the machine of FIG. 1.
Figure 3:
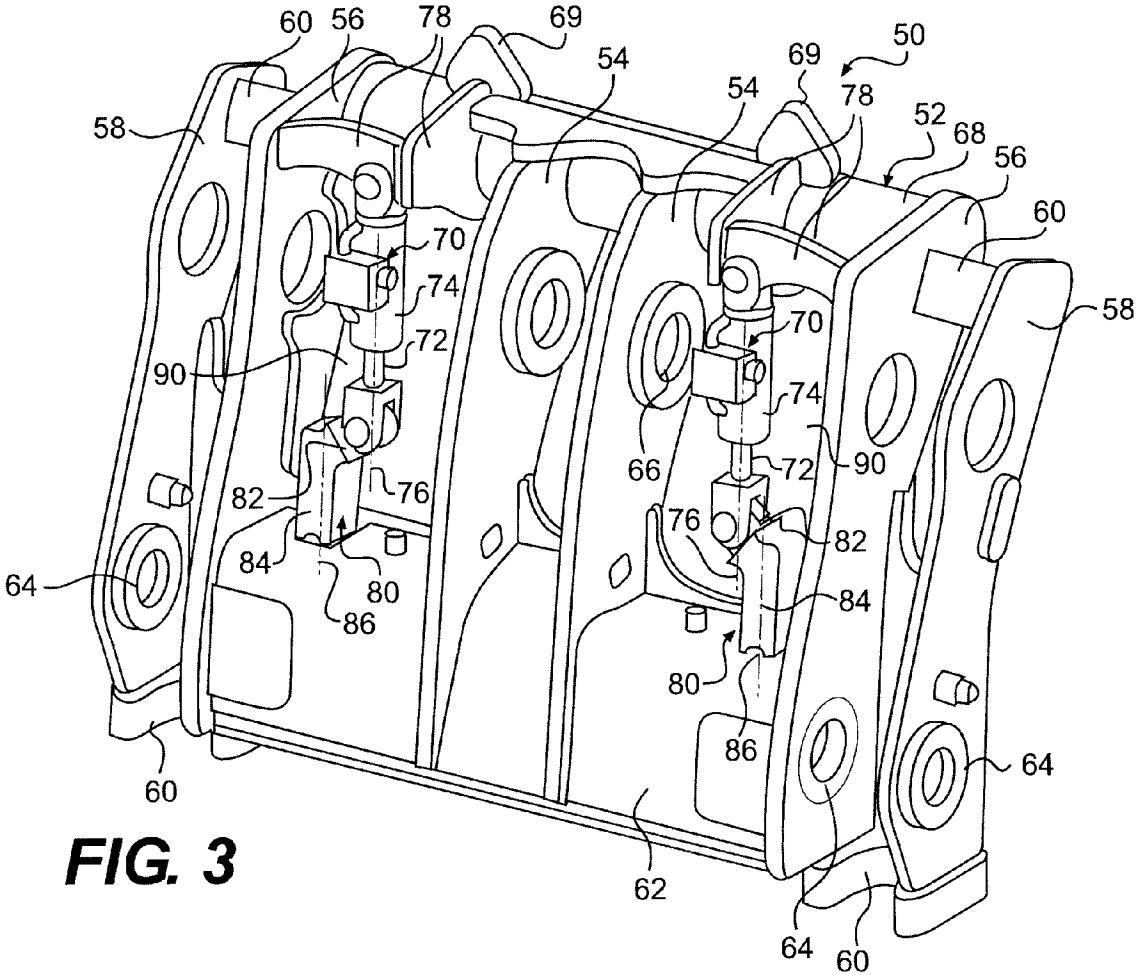
FIG. 3 is a perspective view of the coupler of FIG. 2.
Figure 4:
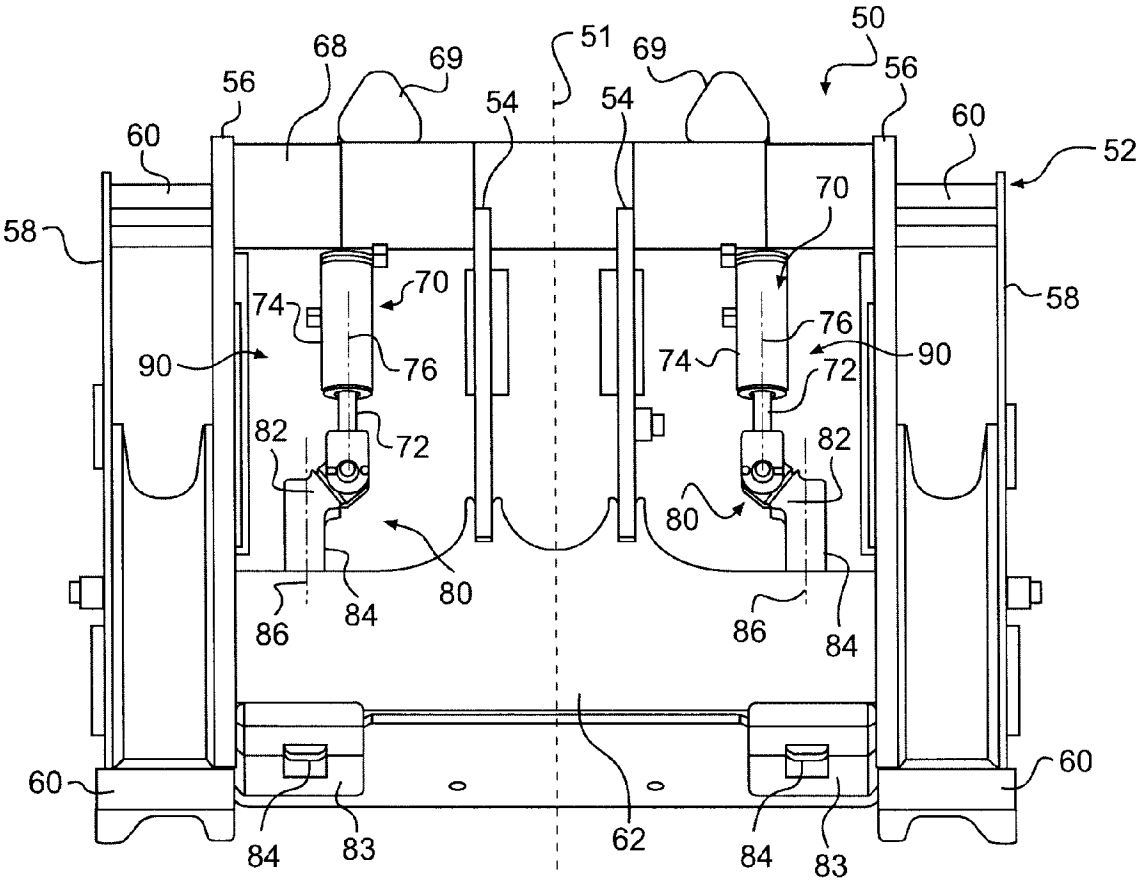
FIG. 4 is a front view of the coupler of FIG. 2.

FIGS. 2-4 illustrate a coupler 50, according to an exemplary embodiment. The coupler 50 may be removably attached to the linkage system 20, and the pallet fork 30 may be removably attached to the coupler 50, as described in more detail below. FIG. 2 shows the coupler 50 connecting the pallet fork 30 to the lift arms 22 and the tilt link 24 of the machine 10, and FIGS. 3 and 4 show the coupler 50 unconnected to the machine 10 or the pallet fork 30.

The coupler 50 may include a frame 52 that may include a mounting structure (described in detail below) for attaching the coupler 50 to various implements, such as the pallet fork 30, and a mounting structure (described in detail below) for attaching the coupler 50 to the machine 10. The frame 52 provides rigidity between the mounting structures, and transfers forces between the machine 10 and the connected implement. The structure of the frame 52 may vary depending on the type of machine 10, the type of implement(s) intended to be coupled with the coupler 50, etc.

The frame 52 may include one or more plate-shaped center members 54, one or more plate-shaped middle members 56, and one or more plate-shaped end members 58. In the embodiment shown in FIGS. 2-4, the frame 52 includes two center members 54, two middle members 56, two end members 58, and a centerline 51 (FIG. 4) may extend along a plane bisecting at least a portion of the coupler 50 (and/or the frame 52). Connecting members 60 attach the end members 58 to the middle members 56. A box structure 62 extends between and ties together the center members 54 and the middle members 56.

FIG. 2 illustrates the coupler 50 attached to the lift arms 22 and the tilt link 24 of the machine 10. According to an exemplary embodiment, the mounting structure for mounting the coupler 50 to the machine 10 may include lift arm bores 64 formed in the middle members 56 and the end members 58 and tilt link bores 66 formed in the center members 54. The tilt link bores 66 may accept a pin 23 for attaching the coupler 50 to the tilt link 24 of the machine 10. The lift arm bores 64 may accept pins 25 for attaching the coupler 50 to the lift arms 22 of the machine 10. The pin joints formed by the pins 25 and the lift arm bores 64 permit relative rotation between the lift arms 22 and the coupler 50. Likewise, the pin joint formed by the pin 23 and the tilt link bores 66 permits rotation of the coupler 50. The tilt link 24 may be attached to a tilt lever 26, as is known in this art, to cause the coupler 50 to tilt, or rack, backward and forward. The lift arms 22 may rotate relative to the machine 10 at their ends opposite the coupler 50 to raise and lower the coupler 50.

According to an exemplary embodiment, the mounting structure for mounting the different implements, such as the pallet fork 30, to the coupler 50 may include an elongated member, such as a tube 68, of the frame 52 that extends between the middle members 56 and is also attached to the center members 54.

The mounting structure for attaching the coupler 50 to various implements may also include one or more actuators, such as hydraulic cylinders 70, mounted at one end to the frame 52. In the exemplary embodiment, the coupler 50 includes two hydraulic cylinders 70. As is known in the art, each hydraulic cylinder 70 includes a cylinder rod 72 that is movable with respect to a cylinder body 74 mounted to the frame 52 under power of pressurized hydraulic fluid. Alternatively, instead of being hydraulically actuated, other actuators may be provided, such as pneumatic or other similarly actuated cylinders. Each hydraulic cylinder 70 is operable to extend the cylinder rod 72 from, and retract the cylinder rod 72 into, the cylinder body 74. The cylinder rod 72 may move with respect to the cylinder body 74 along a linear path of movement that is generally parallel to a longitudinal axis 76 of the cylinder rod 72. In the exemplary embodiment, the longitudinal axis 76 of the cylinder rod 72 is generally parallel to and collinear with the longitudinal axis of the cylinder body 74.

The cylinder bodies 74 of the hydraulic cylinders 70 may be mounted to the frame 52 by respective connecting members 78. In the exemplary embodiment, the connecting members 78 include one portion connecting to the tube 68 and another portion connecting to the respective middle members 56. Alternatively, the connecting members 78 may include only the portions connecting to the tube 68, or only the portions connecting to the respective middle members 56. As another alternative, the connecting members 78 may be omitted and the hydraulic cylinders 70 may connect directly to the tube 68 or the respective middle members 56.

Wedges 80 are connected to the ends of the respective cylinder rods 72 (opposite the ends extending into the cylinder bodies 74). The hydraulic cylinders 70 are configured to extend and retract the wedges 80. The extension and retraction of the wedges 80 occurs during the mounting and dismounting of the implement (e.g., the pallet fork 30) to the coupler 50. Although two hydraulic cylinders 70 are illustrated, a single hydraulic cylinder 70 with a linkage system may be used to extend and retract both wedges 80. For example, the operator in the cab 16 may initiate, with a single input via an input device (not shown), e.g., in the cab 16, actuation of both hydraulic cylinders 70. In an embodiment, the various components of the coupler 50, e.g., the center member 54, middle member 56, end member 58, hydraulic cylinder 70, and wedge 80, on one side of the centerline 51 may be substantially a mirror image of the same components on the other side of the centerline 51, as shown in FIG. 4.

As shown in FIGS. 3 and 4, the wedges 80 may each include an angled portion 82 and a tip portion 84. Each angled portion 82 may connect to the cylinder rod 72 of the corresponding hydraulic cylinder 70, e.g., by a pin joint, and therefore serves to connect the tip portion 84 of the respective wedge 80 to the corresponding cylinder rod 72. Each tip portion 84 includes a longitudinal axis 86, and is configured to move along a linear path of movement that is generally parallel to the longitudinal axis 76 of the corresponding cylinder rod 72 when the hydraulic cylinders 70 extend and retract the wedges 80. The tip portion 84 may be positioned with respect to the cylinder rod 72 such that the longitudinal axis 76 of the cylinder rod 72 is generally parallel to and/or coplanar with the longitudinal axis 86 of the tip portion 84. The longitudinal axes 76, 86 may also be generally parallel to the centerline 51 of the coupler 50 (and/or the frame 52) and/or the plane bisecting the coupler 50. In an embodiment, the tip portion 84 may be approximately 10 to 25 millimeters from the adjacent middle member 56. Alternatively, the tip portion may be less than 10 millimeters or greater than 25 millimeters from the adjacent middle member 56.

The tip portion 84 may be positioned with respect to the attached cylinder rod 72 such that the longitudinal axis 86 of the tip portion 84 is offset from the longitudinal axis 76 of the attached cylinder rod 72 towards the outboard side of the coupler 50 (e.g., outward from the centerline 51 of the coupler 50), as shown in FIG. 4. For example, the longitudinal axes 76, 86 may be offset by a finite distance, e.g., at least approximately 20 millimeters, between approximately 20and approximately 60 millimeters, approximately 52 millimeters, greater than (or equal to) approximately 60 millimeters, etc.

Since the offset between the longitudinal axes 76, 86 allows the hydraulic cylinders 70 to be positioned closer to the centerline 51 of the coupler 50, an opening or window 90 of visibility may be formed that extends through the coupler 50 at two locations. The longitudinal axes 86 of the wedge tip portions 84 may extend towards the respective windows 90, as shown in FIG. 4. For example, a first window 90 may be formed between the tube 68, one of the cylinder bodies 74 (a first cylinder body), the middle member 56 closer to the first cylinder body, and the wedge tip portion 84 attached to the first cylinder body via the corresponding angled portion 82. A second window 90 may be formed between the tube 68, the other one of the cylinder bodies 74 (a second cylinder body), the middle member 56 closer to the second cylinder body, and the wedge tip portion 84 associated with the second cylinder body via the corresponding angled portion 82. For example, each window 90 may have a width of approximately 100 millimeters (e.g., between the cylinder body 74 and the middle member 56 closer to the cylinder body 74). Alternatively, the width may be between approximately 90 millimeters and approximately 100 millimeters, less than approximately 90 millimeters, or greater than approximately 100 millimeters. The distance between the cylinder body 74 and the center member 54 closer to the cylinder body 74 may be approximately 115 millimeters. Alternatively, the distance may be between approximately 90 millimeters and approximately 115 millimeters, less than approximately 90 millimeters, or greater than approximately 115 millimeters. The windows 90 may lie generally within a line of sight 92 of the operator operating the machine 10 from the cab 16, as shown in FIG. 1. Alternatively, the windows 90 may be formed in other locations in the coupler 50 to provide other lines of sight for the operator in the cab 16.

Figure 5:
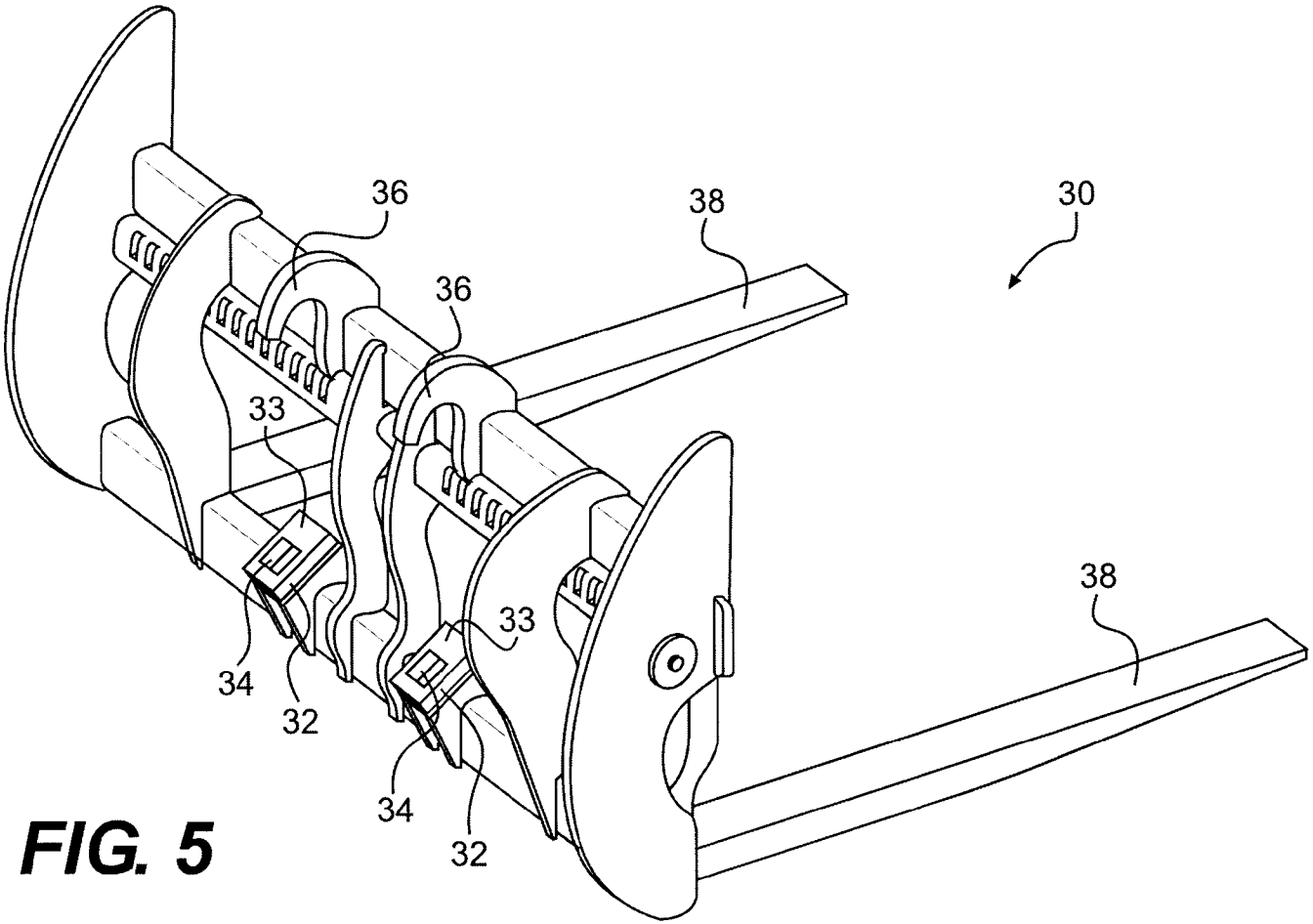
FIG. 5 is a perspective view of the pallet fork of FIG. 2.

FIG. 5 illustrates one of the various types of interchangeable implements, the pallet fork 30, that may be mounted to the coupler 50. The pallet fork 30 includes a mounting structure to mount the pallet fork 30 to the coupler 50. The mounting structure includes one or more wedge plates 32. In the exemplary embodiment, the pallet fork 30 includes two wedge plates 32. Each wedge plate 32 may include a wedge pocket 34 configured to accept the corresponding wedges 80 of the coupler 50. The wedge pockets 34 may be formed as rectangularly-shaped cut through holes in the corresponding wedge plate 32, with sides that are parallel to one another and perpendicular to the top of the wedge plate 32. The mounting structure may also include one or more hooks 36, and each of the hooks 36 may be generally circularly defined with a center point along a central axis. The central axes of the hooks 36 may be coaxial. Each of the hooks 36 may be configured to mount to the tube 68 of the coupler 50. The pallet fork 30 also includes one or more generally horizontal tines 38, as is known in the art, that are configured to engage and/or lift palletized and/or non-palletized materials. The tines 38 may be fixed or adjustable to vary the distance between the tines 38. In an exemplary embodiment, the distance between the tines 38 (e.g., between the outside surfaces of the tines 38 that face away from the center of the pallet fork 30) may be approximately 600 millimeters or approximately 1050 millimeters. Alternatively, the distance between the tines 38 may be less than approximately 600 millimeters, between approximately 600 millimeters and approximately 1050 millimeters, or greater than approximately 1050 millimeters. Certain details of the pallet fork 30 shown in FIG. 5 have been omitted from FIGS. 1, 2, and 6 for ease of illustration.

When attaching the pallet fork 30 to the coupler 50 after the coupler 50 is attached to the lift arms 22 of the machine 10, first the pallet fork 30 may be positioned with respect to the coupler 50 so that the tube 68 may be positioned in the hooks 36, as shown in FIG. 2. The machine operator then operates the machine 10, e.g., from inside the cab 16, to lift the lift arms 22, thereby lifting the coupler 50 and the pallet fork 30. If necessary, the operator may then tilt or rack back the coupler 50 until the wedges 80 are positioned over the wedge pockets 34 of the pallet fork 30. The operator may then command, from inside the cab 16 via an auxiliary hydraulic circuit, the hydraulic cylinders 70 to extend, thereby causing the wedges 80 to advance into the wedge pockets 34. When the wedges 80 are advanced into the wedge pockets 34, the coupler 50 may be permitted to rotate slightly relative to the pallet fork 30 around the center of the hooks 36 and the tube 68. The hydraulic cylinders 70 may advance the wedges 80 into the corresponding wedge pockets 34 to couple or engage the pallet fork 30 to the coupler 50. The pallet fork 30 may be released from the coupler 50 by reversing the same procedure.

The top tube 68 may include ears 69. When the coupler 50 is mounted to an implement, such as the pallet fork 30, the ears 69 may abut the hooks 36, as shown in FIG. 2. This helps prevent the pallet fork 30 from twisting relative to the coupler 50 and helps prevent relative movement between the pallet fork 30 and the coupler 50.

The wedges 80 may be retracted from the corresponding wedge pockets 34 in the pallet fork 30 so that the coupler 50 may be detached from the pallet fork 30. In the retracted positions shown in FIG. 4, the wedge tip portions 84 may extend at least partially out from the frame 52 through a corresponding wedge coupling surface 83 (FIG. 4) which at least partially surrounds each wedge 80. For example, if the wedge tip portions 84 extend out from the frame 52 in their retracted positions, the wedge tip portions 84 may be inserted into the corresponding wedge pockets 34 so that the pallet fork 30 may be positioned with respect to the coupler 50 before actuating the hydraulic cylinders 70. The pallet fork 30 also has wedge coupling surfaces 33 (FIG. 5) formed on the corresponding wedge plates 32, which at least partially surround the wedge pockets 34, respectively. The surfaces 33, 83 are at least approximately parallel when the coupler 50 engages the pallet fork 30. An exemplary configuration of, for example, the wedge coupling surfaces 33, 83 and the wedge tip portions 84 is disclosed in U.S. Pat. No. 7,814,689, entitled "Quick Coupler," which is hereby incorporated by reference in its entirety.

Figure 6:
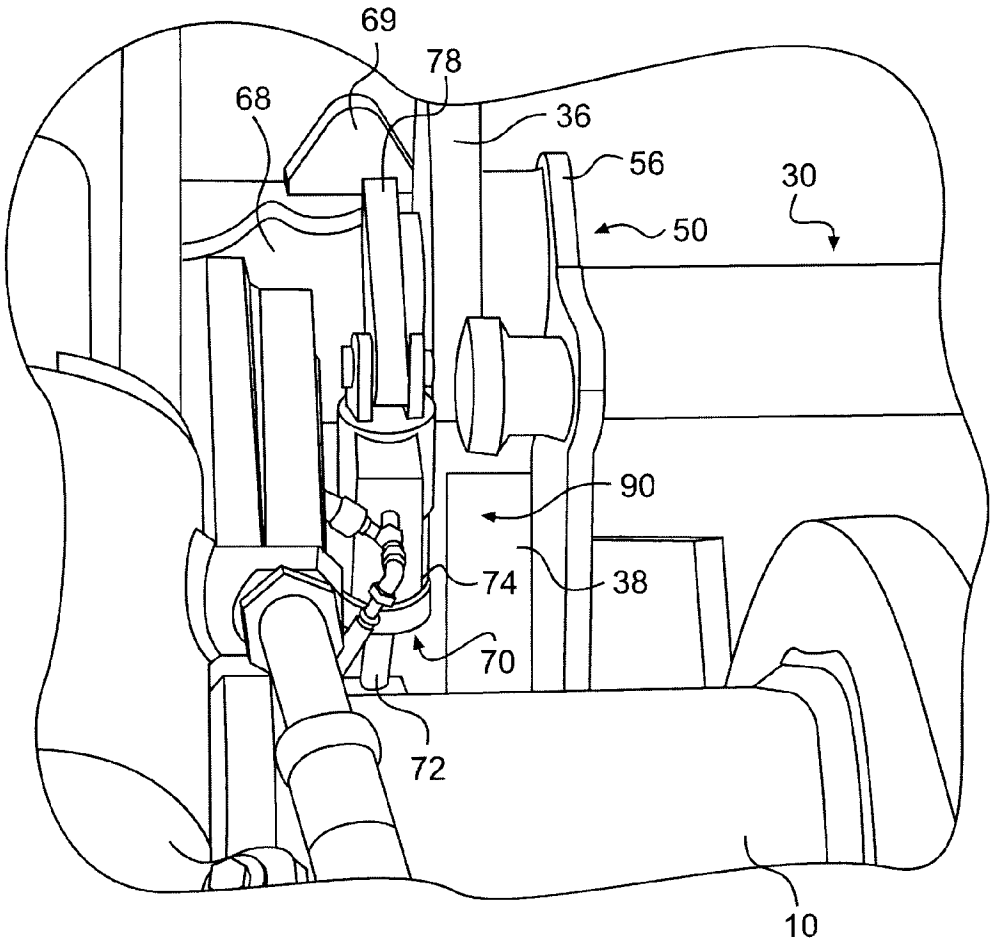
FIG. 6 is a perspective view of the coupler mounting the pallet fork to the machine from the perspective of an operator in a cab of the machine of FIG. 2.

FIG. 6 shows a portion of the coupler 50 mounting the pallet fork 30 to the machine 10, taken from the perspective of the operator in the cab 16 of the machine 10 along the operator's line of sight 92, as described above and shown in FIG. 1. This perspective shows only a portion of the operator's full perspective along the operator's line of sight 92 since only one window 90 is shown. The operator's line of sight 92 allows the operator to see at least a portion (e.g., the distal end) of one of the tines 38 through the window 90. It is understood that the operator's full perspective along the line of sight 92 may include both windows 90, which allows the operator to see portions (e.g., both distal ends) of both tines 38 of the pallet fork 30. Thus, when the coupler 50 connects the pallet fork 30 to the machine 10, at least a portion of at least one tine 38 is within the operator's line of sight 92 through at least one of the windows 90 while the operator is in the cab 16.

The details of the pallet fork 30 and the coupler 50 shown in FIG. 6 may differ from the pallet fork 30 and the coupler 50 shown in FIGS. 1-5. For example, in FIG. 6, one connecting member 78 connects the cylinder body 74 to the tube 68.

Industrial Applicability

The disclosed coupler 50 may be applicable to any machine to which an implement is mounted. Several advantages may be associated with the coupler 50. For example, the coupler 50 may be easy to use, and may allow for fast mounting to the machine 10 and/or the implement.

The coupler 50 may also provide greater visibility to the operator operating the machine 10 from the cab 16. For example, as discussed above, the operator may have the line of sight 92 through the coupler 50 to various areas on and through the implement during and after mounting of the implement. The placement of the hydraulic cylinders 70 and the shape of the wedges 80 may be adjusted to improve visibility.

For example, the windows 90 may allow the operator in the cab 16 to see through the coupler 50 to the tines 38 of the pallet fork 30, e.g., the distal ends of the tines 38, thereby enabling the operator to see when the tines 38 are positioned properly to engage or lift materials, e.g., to position the tines 38 in a pallet. For example, the operator may view one of the tines 38 through one of the windows 90 and the other one of the tines 38 through the other one of the windows 90. The amount of the offset between the longitudinal axes 76, 86 described above (and therefore the size of the windows 90) may depend on various factors, such as size of the pallet fork 30 (e.g., the space between the tines 38, the length of the tines 38, etc.), the distance between the pallet fork 30 and the cab 16, a desired area of the pallet fork 30 or other implement to view, the forces and/or bending loads acting on the wedges 80 when actuated, etc. As a result, providing one or more of the windows 90 gives the operator increased confidence and increases the efficiency of the operation, e.g., the handling and transport of palletized and/or non-palletized materials.

Various types of implements may be used interchangeably with the coupler 50. The implements may include the windows 90 of visibility described above and/or other implements without the windows 90. The distance between the wedge tip portions 84 of the coupler 50 (or the distance between the longitudinal axes 86 of the tip portions 84) may be determined based on a set distance between the wedge pockets 34 in the interchangeable implements that are intended to be mounted to the coupler 50. The set distance may be generally constant between implements having the windows 90 of visibility and without the windows 90. Thus, the coupler 50 includes the windows 90 that allow for increased visibility for the operator while remaining useable with other various types of implements, such as buckets and other types of implements for which the operator may not necessarily desire to have increased visibility. As a result, since various types of implements may be used with the disclosed coupler 50, the design may be versatile and less costly to manufacture and use.

It will be apparent to those skilled in the art that various modifications and variations can be made to the coupler. Other embodiments will be apparent to those skilled in the art from consideration of the specification and practice of the disclosed coupler. It is intended that the specification and examples be considered as exemplary only, with a true scope being indicated by the following claims and their equivalents.

What is claimed is:

1. A coupler for connecting an implement to a machine, the coupler comprising:

a first mounting structure configured to attach the coupler to the implement, the first mounting structure comprising:

a first actuator including a first cylinder rod extendable relative to a first cylinder body, the first cylinder rod having a first rod longitudinal axis;

a first wedge attached to the first cylinder rod, the first wedge being movable between a retracted position and an extended position by the first actuator, the first wedge including a first wedge tip insertable into the implement, the first wedge tip having a first wedge longitudinal axis, the first rod longitudinal axis being offset with respect to a width of the machine from the first wedge longitudinal axis to form a first opening extending through the coupler adjacent the first actuator; and a second mounting structure configured to attach the coupler to the machine.

2. The coupler of claim 1, wherein the first rod longitudinal axis is offset from the first wedge longitudinal axis by a distance that is greater than approximately 20 millimeters and less than approximately 60 millimeters.

3. The coupler of claim 1, wherein:

the implement is a pallet fork including at least one tine; and the first opening extends through the coupler adjacent the first actuator so that, when the coupler connects the implement to the machine, at least a portion of the at least one tine is within a line of sight of an operator operating the machine in a cab of the machine through the first opening.

4. The coupler of claim 1, further comprising:

a frame including a first plate-shaped member and a second plate-shaped member;

wherein the first actuator is located between the first and second plate-shaped members, and the first opening extends between one of the first and second plate-shaped members and the first actuator.

5. The coupler of claim 4, wherein the first plate-shaped member and the second plate-shaped member include the second mounting structure, and the second mounting structure includes at least one lift arm bore configured to attach to at least one lift arm of the machine.

6. The coupler of claim 4, wherein:

the frame further comprises an elongated member connecting the first plate-shaped member and the second plate-shaped member;

the first cylinder body is attached to the elongated member; and the first opening extends between the elongated member and the first wedge.

7. The coupler of claim 1, wherein the first mounting structure further comprises:

a second actuator including a second cylinder rod extendable relative to a second cylinder body, the second cylinder rod having a second rod longitudinal axis;

a second wedge attached to the second cylinder rod, the second wedge being movable between a retracted position and an extended position by the second actuator, the second wedge including a second wedge tip insertable into the implement, the second wedge tip having a second wedge longitudinal axis;

wherein the second rod longitudinal axis is offset from the second wedge longitudinal axis to form a second opening extending through the coupler adjacent the second actuator.

8. The coupler of claim 1, wherein the first actuator is a hydraulic cylinder.

9. The coupler of claim 1, wherein the first rod longitudinal axis is offset from the first wedge longitudinal axis so that, when the coupler connects the implement to the machine, at least a first portion of the implement is within a line of sight of an operator operating the machine in a cab of the machine through the first opening.

10. The coupler of claim 1, wherein the first rod longitudinal axis is generally parallel to the first wedge longitudinal axis.

11. A coupler for coupling a first body to a second body, the coupler comprising:

a frame including a first mounting structure configured to attach the coupler to the first body and a second mounting structure configured to attach the coupler to the second body, the first mounting structure comprising:

a first actuator including a first cylinder rod extendable relative to a first cylinder body, the first cylinder rod having a first rod longitudinal axis, and a first wedge attached to the first cylinder rod, the first wedge being movable between a retracted position and an extended position by the first actuator, the first wedge including a first wedge tip insertable into the first body, the first wedge tip having a first wedge longitudinal axis;

wherein the first rod longitudinal axis is offset from the first wedge longitudinal axis to form a first opening extending entirely through the coupler adjacent the first actuator, the first opening extending between the frame and the first actuator above the first wedge, the first wedge longitudinal axis extending towards the first opening.

12. The coupler of claim 11, wherein the first mounting structure further comprises an elongated member configured to couple to at least one engaging device on the first body.

13. The coupler of claim 12, wherein:

the at least one engaging device comprises at least one hook; and the elongated member comprises a tube configured to be received by the at least one hook.

14. The coupler of claim 11, wherein:

the first wedge longitudinal axis and the first rod longitudinal axis are generally parallel to a centerline of the coupler; and the first rod longitudinal axis is offset from the first wedge longitudinal axis such that the first wedge longitudinal axis is farther from the centerline of the coupler than the first rod longitudinal axis.

15. The coupler of claim 11, wherein the first mounting structure further comprises:

a second actuator including a second cylinder rod extendable relative to a second cylinder body, the second cylinder rod having a second rod longitudinal axis, and a second wedge attached to the second cylinder rod, the second wedge being movable between a retracted position and an extended position by the second actuator, the second wedge including a second wedge tip insertable into the first body, the second wedge tip having a second wedge longitudinal axis;

wherein the second rod longitudinal axis is offset from the second wedge longitudinal axis to form a second opening extending through the coupler adjacent the second actuator, the second opening extending between the frame and the second actuator above the second wedge, the second wedge longitudinal axis extending towards the second opening.

16. The coupler of claim 15, wherein:

the first rod longitudinal axis is offset from the first wedge longitudinal axis such that the first wedge longitudinal axis is farther from a centerline of the coupler than the first rod longitudinal axis; and the second rod longitudinal axis is offset from the second wedge longitudinal axis such that the second wedge longitudinal axis is farther from the centerline of the coupler than the second rod longitudinal axis.

17. The coupler of claim 15, wherein the first wedge longitudinal axis, the first rod longitudinal axis, the second wedge longitudinal axis, and the second rod longitudinal axis are generally parallel to a centerline of the coupler.

18. The coupler of claim 11, wherein:

the first body is an implement;

the second body is a machine; and the first opening is configured so that, when the coupler connects the implement to the machine, at least a portion of the implement is within a line of sight of an operator operating the machine in a cab of the machine.

19. A method of coupling an implement to a machine, the method comprising:

attaching a coupler to the machine, the coupler comprising a top portion, a bottom portion, and two side portions extending between the top and bottom portions;

attaching the implement to the coupler by:

actuating a first actuator including a first cylinder rod extendable relative to a first cylinder body, the first cylinder rod having a first rod longitudinal axis, a first wedge being attached to the first cylinder rod, the first wedge being movable between a retracted position and an extended position when the first actuator is actuated, and advancing a first wedge tip of the first wedge into a first wedge pocket in the implement when the first actuator is actuated to position the first wedge in the extended position, the first wedge tip having a first wedge longitudinal axis, the first wedge longitudinal axis being offset from the first rod longitudinal axis toward one of the side portions of the coupler; and providing a first opening extending through the coupler and adjacent the first actuator to allow an operator operating the machine in a cab of the machine to see through the first opening to at least a portion of the implement.

20. The method of claim 19, wherein attaching the coupler to the machine comprises attaching at least one lift arm and a tilt link of the machine to a frame of the coupler.

21. The method of claim 19, wherein attaching the implement to the coupler further includes:

receiving an input from the operator;

actuating a second actuator including a second cylinder rod extendable relative to a second cylinder body, the second cylinder rod having a second rod longitudinal axis, a second wedge being attached to the second cylinder rod, the second wedge being movable between a retracted position and an extended position when the second actuator is actuated, the first and second actuators being actuated in response to the operator input; and advancing a second wedge tip of the second wedge into a second wedge pocket in the implement when the second actuator is actuated to position the second wedge in the extended position, the second wedge tip having a second wedge longitudinal axis, the second rod longitudinal axis being offset from the second wedge longitudinal axis.

22. The method of claim 19, wherein the first opening is formed between the first actuator, the top portion of the coupler, the one of the side portions of the coupler, and the first wedge tip.

* * * * *

UNITED STATES PATENT AND TRADEMARK OFFICE

CERTIFICATE OF CORRECTION

PATENT NO. : 8,833,480 B2
APPLICATION NO. : 13/168801
DATED : September 16, 2014
INVENTOR(S) : Grimes et al.

It is certified that error appears in the above-identified patent and that said Letters Patent is hereby corrected as shown below:

In the Specification

Column 5, line 38, delete “20and” and insert -- 20 and --.

Column 7, line 38, delete “Industrial Applicability” and insert -- INDUSTRIAL APPLICABILITY --.

Signed and Sealed this
Fifteenth Day of September, 2015

Michelle K. Lee

Michelle K. Lee
*Director of the United States Patent and Trademark Office*